US006502414B1

(12) United States Patent
Calvert

(10) Patent No.: US 6,502,414 B1
(45) **Date of Patent: *Jan. 7, 2003**

(54) COOLER HOUSING APPARATUS AND METHOD OF MAKING THE SAME

(75) Inventor: Phillip D. Calvert, Center, TX (US)

(73) Assignee: General Shelters of Texas, S.B., Ltd., Center, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/844,983

(22) Filed: Apr. 27, 2001

Related U.S. Application Data

(63) Continuation of application No. 09/273,096, filed on Mar. 19, 1999, now Pat. No. 6,223,548.
(60) Provisional application No. 60/078,741, filed on Mar. 20, 1998.

(51) Int. Cl.[7] ..... F25D 5/00
(52) U.S. Cl. ..... 62/304; 62/314
(58) Field of Search ..... 62/304, 314, 259.1, 62/298, 239, 310, 271; 261/DIG. 3, DIG. 43; 454/337

(56) References Cited

U.S. PATENT DOCUMENTS

| | | | | |
|---|---|---|---|---|
| 2,094,870 | A | | 10/1937 | Brown |
| 2,450,647 | A | * | 10/1948 | Essick |
| 2,497,947 | A | | 2/1950 | Lewis |
| 2,807,505 | A | | 9/1957 | Weitzel |
| 3,290,866 | A | * | 12/1966 | Schonrock |
| 3,730,642 | A | | 5/1973 | Barnstead et al. |
| 3,731,057 | A | | 5/1973 | Kunz et al. |
| 3,802,493 | A | * | 4/1974 | Goettl |
| 3,977,606 | A | | 8/1976 | Wyss |
| 4,031,180 | A | | 6/1977 | Bohanon |
| 4,419,300 | A | | 12/1983 | VanNess et al. |
| 4,428,890 | A | | 1/1984 | Harrell |
| 4,443,386 | A | | 4/1984 | Wrightson |
| 4,468,357 | A | | 8/1984 | Miller et al. |
| 4,479,366 | A | | 10/1984 | Lanier et al. |
| 4,499,030 | A | | 2/1985 | Stewart |
| 4,560,972 | A | | 12/1985 | Britt |
| D284,505 | S | | 7/1986 | Bowman et al. |
| D284,999 | S | | 8/1986 | Worthington et al. |
| 4,607,499 | A | | 8/1986 | Bolton et al. |
| 4,615,182 | A | | 10/1986 | Worthington |
| 4,701,286 | A | | 10/1987 | Stillman et al. |
| 4,798,060 | A | | 1/1989 | Long et al. |
| 4,835,982 | A | * | 6/1989 | Ferdows ..... 62/239 |
| 4,933,117 | A | | 6/1990 | Wilson |
| 4,935,169 | A | | 6/1990 | Ernst |

(List continued on next page.)

OTHER PUBLICATIONS

International Honeycomb Illinois, Inc.; *Glacier–Cor—The Coolest Idea in Evaporative Cooling Pads*; Brochure.

General Shelters of Texas, Inc.; *General Shelters Introduces Port–A–Cool*; Brochure.

General Shelters of Texas, Inc.; *Port–A–Cool Efficient Spot–Cooling*; Brochure.

General Shelters of Texas, Inc.; *The All New Port–A–Cool Incredible Portable Cooling*; Brochure.

Koolzonairco.html; *Tools For Living*; Web Site; 1999; http://www.tools–for–living/koolzonairco.html; The Magellan Group, Inc.

*Primary Examiner*—Chen-Wen Jiang
(74) *Attorney, Agent, or Firm*—Locke Liddell & Sapp LLP

(57) ABSTRACT

A cooler housing capable of encasing, protecting, and supporting cooler components, particularly components necessary for use as a portable evaporative cooler. Though the housing described herein may be used in cooling devices ranging from simple conventional fans to complex heat exchanger devices, the preferred embodiment of this invention is preferably used in conjunction with a portable evaporative cooler employing this housing and further comprising a motor that drives a pump connected to a sump tank.

27 Claims, 4 Drawing Sheets

U.S. PATENT DOCUMENTS

| | | | | | |
|---|---|---|---|---|---|
| 4,970,876 | A | | 11/1990 | Vinokurov | |
| 4,977,756 | A | | 12/1990 | Brock | |
| 5,042,270 | A | | 8/1991 | Sanchez | |
| 5,055,192 | A | * | 10/1991 | Artinyan et al. | 210/346 |
| 5,079,934 | A | | 1/1992 | Vinokurov | |
| D327,737 | S | | 7/1992 | Sanchez | |
| 5,130,063 | A | | 7/1992 | Collins et al. | |
| 5,147,581 | A | | 9/1992 | Lu | |
| 5,192,464 | A | | 3/1993 | Pawlowski et al. | |
| D337,817 | S | | 7/1993 | Brock | |
| D353,883 | S | | 12/1994 | Blanchard | |
| 5,403,152 | A | | 4/1995 | Trautloff et al. | |
| D362,904 | S | | 10/1995 | Wulf et al. | |
| D362,905 | S | | 10/1995 | Wulf et al. | |
| 5,598,719 | A | | 2/1997 | Jones et al. | |
| 5,606,868 | A | | 3/1997 | Calvert | |
| 5,720,407 | A | | 2/1998 | Hoffman | |
| 5,753,002 | A | * | 5/1998 | Glucksman | 55/471 |
| D397,194 | S | | 8/1998 | Hebert | |

* cited by examiner

COOLER HOUSING APPARATUS AND METHOD OF MAKING THE SAME

This application is a continuation application of U.S. patent application Ser. No. 09/273,096, filed Mar. 19, 1999 now U.S. Pat. No. 6,223,548, which claims benefit to U.S. patent application Ser. No. 60/078,741, filed on Mar. 20, 1998.

FIELD OF THE INVENTION

The present invention is related to a cooler housing that is used for encasing, protecting, and supporting the components that comprise a variety of cooling devices, particularly for use as the housing for portable evaporative coolers.

BACKGROUND OF THE INVENTION

Cooler housings are known in the art. Housings encase, protect, and support the numerous components that may be included within coolers. Additionally, the housing forms an integral part of the cooler by directing the air flow through the cooler. Numerous examples of housings for coolers exist in the prior art. For example, U.S. Pat. No. D362,905 issued Oct. 3, 1995, which is hereby incorporated by reference, depicts a representation of a sophisticated housing for a cooler. This housing provides an integral part of this portable evaporative cooler. Though housings may be employed in a variety of coolers, portable evaporative coolers comprise a variety of components that especially benefit from a strong, rigid, yet portable cooler housing. Describing a representative portable evaporative cooler, U.S. Pat. No. 5,606,868 issued Mar. 4, 1997, which is incorporated by reference herein, demonstrates and discloses that the multitude of components necessary to provide cool air can benefit from an efficient, sturdy, and protective cooler housing. Even these sophisticated examples of cooler housings cannot overcome some of the deficiencies of the prior art.

The prior art forced a user to connect external water sources to the housing through water connections protruding away from the surface of the housing. Bumping or brushing against a wall or other obstacle could damage these connections protruding from the surface of the housing. Therefore a need exists to recess these connections to protect them.

The prior art also created a danger as the pads aged and deteriorated. As the pads softened, a person approaching the pad side or rear of the cooler could stumble against the weakening pads and fall through into the rotating fan. To prevent this risk, the prior art teaches the use of wire mesh gratings or guards in front of the pads. These gratings or guards hinder the replacement of the pads, however.

Water must collect in a central sump tank in evaporative coolers and a pump system must recirculate it through the pads. The prior art teaches the use of one central tank area. This central tank configuration limits the flexibility of the unit and unduly burdens the center of the housing with the entire weight of the water.

In the prior art, the sump of evaporative coolers well typically comprised slanted walls. The flow valves attached to the slanted walls were typically inaccurate because the slant of these walls actually decreases the pressure needed to open the valve. The prior art usually had to employ pressure regulators or pressure reducers to compensate for the problems associated with placing the flow valve on the slanted wall.

Finally, the prior art teaches that the pump was usually secured only by the connection to the hose attachment. The movement of the housing during shipping or movement during use would upset the pump and affect performance.

SUMMARY OF THE INVENTION

The present invention comprises a cooler housing, having a front and rear opening, that is used for coolers, particularly evaporative coolers. Though the housing described herein may be used in coolers ranging from simple conventional fans to comnplex heat exchanger devices, the preferred embodiment of this invention is preferably used in conjunction with a portable evaporative cooler employing this housing and further comprising the necessary components including a motor that drives a pump connected to a sump tank.

The housing preferably comprises at least one recess. Thus, the plumbing assemblies do not protrude from the overall silhouette of the housing. Further, when recessed, the chances of another object striking the assemblies and damaging them is significantly reduced.

Also, the housing comprises a plurality of braces attached to the interior of the housing and bracing the back plane of the pads when installed. This configuration offers the same protection as the guards or gratings that were used in the prior art, but these bars also provide a back support for the pads and keep them aligned within the housing. Additionally, the replacement of the pads can be accomplished without having to contend with removing the cumbersome grating or mesh required in the prior art.

Moreover, the sump tank of the present invention comprises a central base further comprising at least one additional cavity defined by the far edges of the unit, creating pontoon-like structures that extent to the bottom sides of the unit. This structure dramatically increase the volume of water that may be stored in the unit. This housing connects each cavity to the central collection chamber via channels in the bottom of the housing. These channels also provide a support frame. This support frame structure can be connected to wheels or casters that can be affixed or fitted to the housing. Because these pontoon-like structures and the support frame structure evenly distribute the weight of water around the entire bottom of the housing, rather than centralizing the entire weight. This distribution increases the stability of the housing. This stability is increased by a plurality of pylons that strengthen and support the housing by providing additional rigidity.

Furthermore, the present invention further comprises a back wall at the base of the housing with a nearly vertical aspect. This configuration overcomes the problems regarding attached a valve on a slant wall as encountered in the prior art. Any flow valve attached to this surface will be as close to vertically as possible, thus the need for any extraneous flow regulators to compensate for these irregularities has been eliminated.

Finally, the present invention employs a plurality of ridges designed to prevent side to side movement of the pump contained therein. These ridges restrict any lateral movement of the pump. Additionally, the use of an aluminum bracket attached to the back wall of the housing and connected to the hose running from the pump further restricts movement of the pump in all directions. Thus, even the movement and jostling associated with shipping will not jar or displace the pump.

DETAILED DESCRIPTION OF PREFERRED EMBODIMENT

As depicted in FIGS. 1–4, the present invention comprises housing 10, having front opening 11 and rear opening 12, that may be used for encasing, protecting, and supporting components integral in providing air movement and/or relief from the heat. Though the preferred embodiment envisions the use of housing 10 as an integral part of the portable evaporative cooler, housing 10 can provide support and protection for the components of nearly any cooler.

Housing 10 may be formed out of metal, plastic, composites, organic fibers including wood, or any other substance capable of being formed, molded, or otherwise shaped to include at least one aspect of the invention. Housing 10 is preferably formed by rotation molding or resin transfer process.

Figure 1:
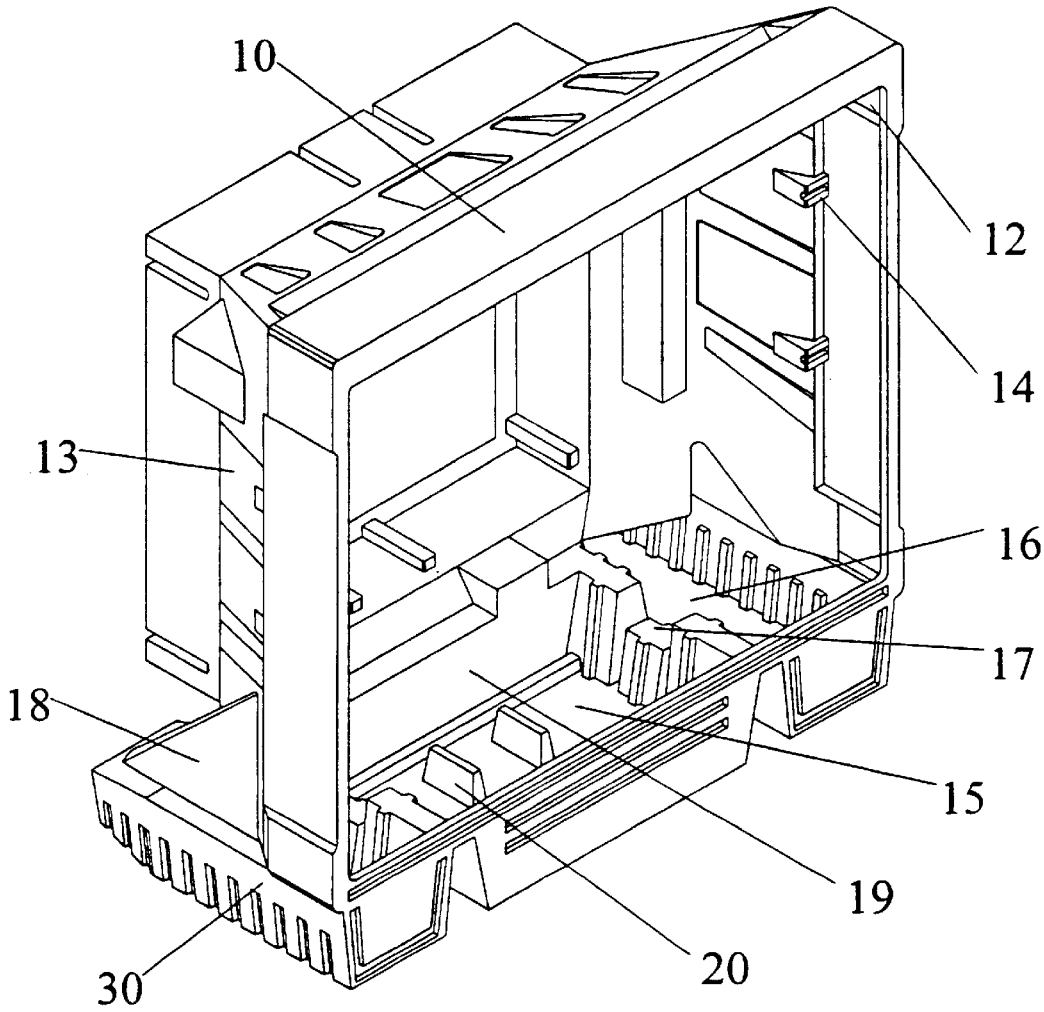
FIG. 1 is a perspective view of the present invention.
Figure 2:
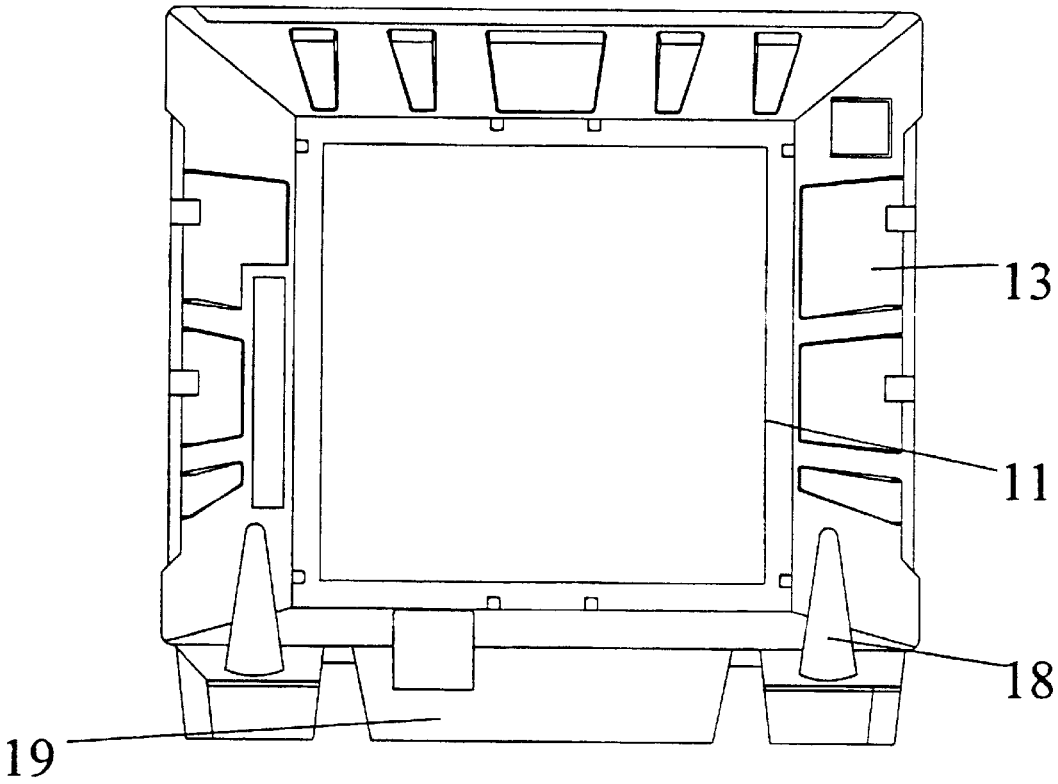
FIG. 2 is a front elevational view of the present invention unit.
Figure 3:
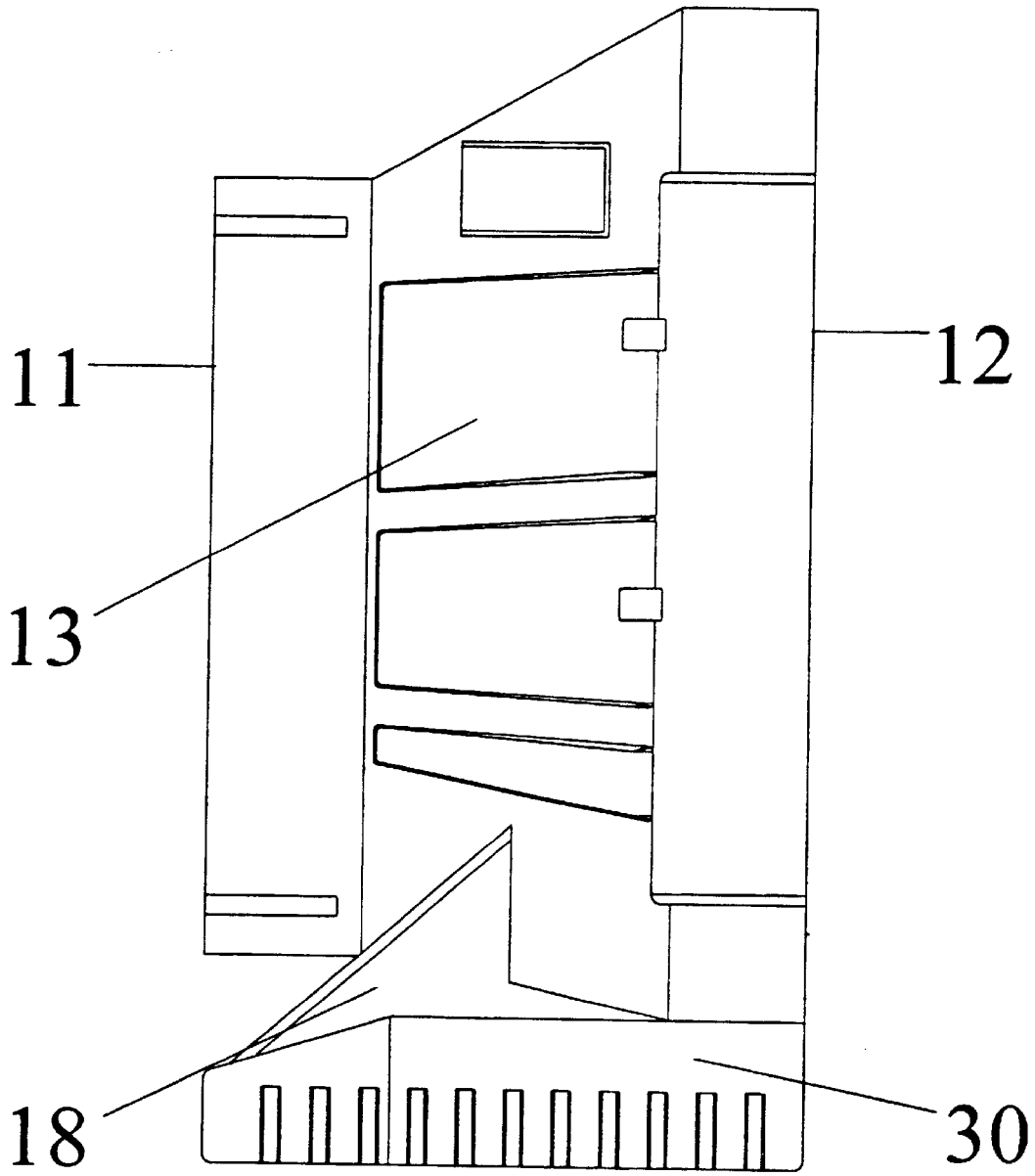
FIG. 3 is a right side elevational view of the present invention.
Figure 4:
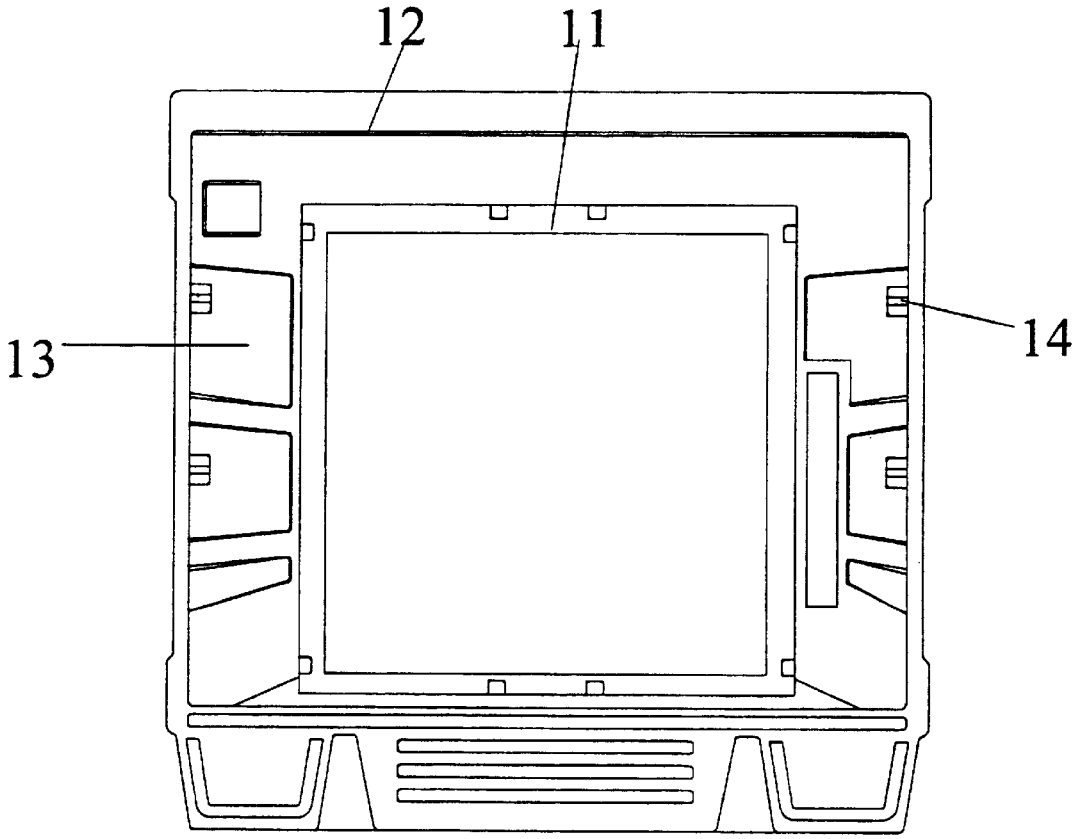
FIG. 4 is a rear elevational view of the present invention.

Referring to FIG. 1, housing 10 comprises a variety of features. Of particular interest, housing 10 comprises at least one recess 13 capable of strengthening housing 10 and offering a prime location for the placement and protection of plumbing assemblies and connections protruding from housing 10. Recesses 13 allow protruding assemblies from being damaged during shipping, movement between uses, and interactions in close proximity to housing 10. Additionally, recesses 13, along with the other exterior features described herein, that provide aesthetic and ornamental aspects that distinguish housing 10 from predecessors in the prior art and allow the formation of product identity.

Additionally, housing 10 may further comprise at least one brace 14 attached to an interior surface of housing 10 or formed integrally therein. Braces 14 provide support for the evaporative cooling pads utilized in a portable evaporative cooler and also strengthen and protect aging pads that may weaken and allow unsafe environments. Though weakening pads offer a variety of unsafe environments, it is envisioned that users may accidentally lean into and ultimately fall into a portable evaporative cooler that does not enjoy the benefits of these braces 14.

Furthermore, central collection chamber 15 formed within the interior of the integrally formed base 30, along with providing an attachment site for wheels or casters, provides the preferable location to store water or similar fluid to be used in conjunction with an evaporative cooler. By forming or otherwise attaching at least one additional cavity 16 defined by the outer walls of base 20, which was previously simply used as a support skid, housing 20, a more particularly base 30, can hold a significantly larger capacity of water or similar liquid to be used in conjunction with an evaporative cooler. Water contained within cavity 16 may flow by gravity to central collection chamber 15 via at least one channel 17 a integrally formed within base 30 of housing 10.

Though recesses 13 in the overall construction of housing 10 provide significant rigidity, the attachment or integral formation of at least one pylon 18 may further support and reinforce housing 10 to provide a more sturdy and efficient housing for use in a cooling device.

With regard to portable evaporative coolers and other devices necessitating the need of using a pump within, a back wall 19 formed within base 30 of housing 10 should be preferably formed such that it maintains a vertical or nearly vertical aspect. By providing a more vertical aspect, pumps or similar liquid moving mechanisms can be efficiently operated without the need to introduce extraneous flow regulators or pressure reducers to compensate for reduced pressures created by slant wall configurations.

Additionally, housing 10 may further comprise at least one ridge 20 attached or integrally formed in base 30 to substantially confine or limit components contained therein. In the preferred embodiment, a plurality of ridges 20 formed within base 30 of housing 10 releasibly confine any lateral movement of components, especially a pump used in a portable evaporative cooler. Though additional measures will be obvious to those skilled in the art, in the preferred embodiment the use of an aluminum bracket attached to back wall 19 can provide additional protection for components including a pump that may be contained within housing 10.

Though the novel features described herein provide protection, support, and aid in encasement of components used in cooling devices, these features, especially the exterior features, also provide an opportunity for the development of ornamental and decorative aspects that may allow recognition and distinction with a particular product line and company identity.

The housing for a cooling unit and its use in forming a portable evaporative cooling unit of the present invention, and many of its intended advantages, will be understood from the foregoing description and it will be apparent that, although the invention and its advantages have been described in detail, various changes, substitutions, and alterations may be made in the form, construction, and arrangement of the parts thereof without departing from the spirit and scope of the invention as defined by the appended claims, or sacrificing its material advantages, the form described previously being merely a preferred or exemplary embodiment thereof.

I claim:

1. An evaporative cooler housing supported on a base, having an exterior and interior and rear opening, wherein the base is integrally formed with the housing, the housing further comprising at least one brace attached to the interior capable of supporting at least one evaporative cooling pad positioned within the rear opening of the housing.

2. The evaporative cooler housing of claim 1, further comprising at least one recess formed within the housing.

3. The evaporative cooler housing of claim 1, further comprising a central collection chamber formed within the interior of the base.

4. The evaporative cooler housing of claim 1, wherein the housing is formed of metal.

5. The evaporative cooler housing of claim 1, wherein a back wall of the base is formed with a substantially vertical aspect.

6. The evaporative cooler housing of claim 1, wherein the housing is formed by rotation molding.

7. The evaporative cooler housing of claim 1, wherein the housing is formed by resin transfer.

8. The evaporative cooler housing of claim 1, further comprising a plurality of wheels or casters attached to the bottom of the base.

9. An evaporative cooler comprising the evaporative cooler housing of claim 1.

10. An evaporative cooler housing, supported on a base, having an exterior, an interior and rear opening, wherein the base is integrally formed with the housing, comprising:

at least one brace attached to the interior of the housing which provides support for an evaporative cooling pad positioned within the rear opening; and a central collection chamber formed within the interior of the base;

wherein the back wall of the base is formed with a substantially vertical aspect.

11. The evaporative cooler housing of claim 10, wherein the housing is formed by rotation molding.

12. The evaporative cooler housing of claim 10, wherein the housing is formed by resin transfer.

13. The evaporative cooler housing of claim 10, further comprising a plurality of wheels or casters attached to the bottom of the base.

14. The evaporative cooler housing of claim 10, further comprising at least one recess formed within the housing.

15. The evaporative cooler housing of claim 10, wherein the housing is formed of metal.

16. An evaporative cooler comprising the evaporative cooler housing of claim 10

17. An evaporative cooler housing supported on a base having an exterior, an interior, and a central chamber formed within the interior of the base of size sufficient to store water needed for use with an evaporative cooler and further wherein the base is integrally formed with the housing.

18. The evaporative cooler housing of claim 17, further comprising at least one recess formed within the housing.

19. The evaporative cooler housing of claim 17, further comprising at least one brace attached or integrally formed within an interior side of the housing wherein the brace provides support for an evaporative cooling pad positioned within the rear opening.

20. The evaporative cooler housing of claim 17, further comprising at least one additional cavity formed within the interior of the base and in communication with the central collection area via at least one channel formed in the base.

21. The evaporative cooler housing of claim 17, further comprising at least one pylon attached or integrally formed into the exterior.

22. The evaporative cooler housing of claim 17, wherein a back wall of the base is formed with a substantially vertical aspect.

23. The evaporative cooler housing of claim 17, wherein the housing is formed of metal.

24. The evaporative cooler housing of claim 17, wherein the housing is formed by rotation molding.

25. The evaporative cooler housing of claim 17, wherein the housing is formed by resin transfer process.

26. An evaporative cooler comprising the evaporative cooler housing of claim 17.

27. The evaporative cooler housing of claim 17, further comprising a plurality of wheels or casters affixed to a bottom surface of the base.

* * * * *